United States Patent [19]

Lyman

[11] Patent Number: 4,554,700

[45] Date of Patent: Nov. 26, 1985

[54] INVISIBLE HINGE MEANS FOR LID AND HOOD OF A CANISTER VACUUM CLEANER

[75] Inventor: John B. Lyman, Bloomington, Minn.

[73] Assignee: Whirlpool Corporation, Benton Harbor, Mich.

[21] Appl. No.: 641,284

[22] Filed: Aug. 16, 1984

[51] Int. Cl.[4] ..... A47L 90/00

[52] U.S. Cl. ..... 15/323; 15/327 F; 16/355; 16/363

[58] Field of Search ..... 15/327 R, 327 F, 327 D, 15/327 E, 323; 16/355, 362, 363

[56] References Cited

U.S. PATENT DOCUMENTS

| | | | |
|---|---|---|---|
| 2,056,805 | 10/1936 | Reichard | 16/355 |
| 2,494,347 | 1/1950 | Matthews | 16/171 |
| 2,627,327 | 2/1953 | Backman | 16/355 X |
| 2,765,949 | 10/1956 | Hillman | 220/31 |
| 2,964,351 | 12/1960 | White | 296/57 |
| 3,087,192 | 4/1963 | Hertzke | 16/128 |
| 3,200,432 | 8/1965 | Voegeli et al. | 15/323 |
| 3,238,706 | 3/1966 | Kurlinski | 15/327 R X |
| 3,254,359 | 7/1966 | Coll | 15/323 X |
| 3,255,480 | 6/1966 | Segesman | 15/327 R |
| 3,256,553 | 6/1966 | Schnur | 16/178 |
| 3,365,094 | 1/1968 | Palson | 220/31 |
| 3,392,820 | 7/1968 | Azim | 206/1 |
| 3,456,913 | 7/1969 | Lutz | 244/63 |
| 3,619,850 | 11/1971 | Rideout et al. | 15/323 |
| 3,651,536 | 3/1972 | Bolzan et al. | 15/323 |
| 3,718,943 | 3/1973 | Bustin | 16/355 |
| 4,123,822 | 11/1978 | Bentley | 16/128 R |
| 4,333,206 | 6/1982 | Lang et al. | 16/335 |

FOREIGN PATENT DOCUMENTS

| | | | |
|---|---|---|---|
| 36-25063 | 3/1981 | Japan | 16/355 |

*Primary Examiner*—Chris K. Moore

*Attorney, Agent, or Firm*—Wood, Dalton, Phillips, Mason & Rowe

[57] ABSTRACT

A vacuum cleaner structure having an invisible hinge structure hingedly mounting a hood to the vacuum cleaner body and a lid to the hood. The body defines an arcuate guide slidably receiving an arcuate slide-track for hingedly mounting the hood to the body. A track portion of the slide-track, in turn, slidably carries an arcuate slide on the lid for hingedly mounting the lid to the slide-track and thereby hingedly mounting the lid indirectly to the body. The body guide, the hood slide-track, and the lid slide are each arcuately centered on a common axis disposed rearwardly of a rear wall defining the filter bag space of the vacuum cleaner with the common axis being disposed outside the confines of the vacuum cleaner body to facilitate interference-free opening and closing of the hood and lid. The hood slide-track and lid slide are received within the body rearwardly of the rear wall so as to define an invisible hinge mounting of the hood and lid to the body. In the illustrated embodiment, the slide is formed integrally with the lid and the slide-track is formed integrally with the hood.

26 Claims, 8 Drawing Figures

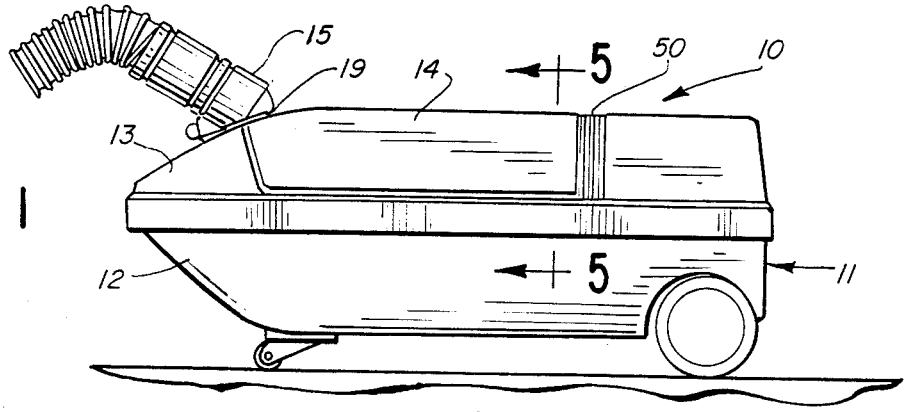
FIG. 1
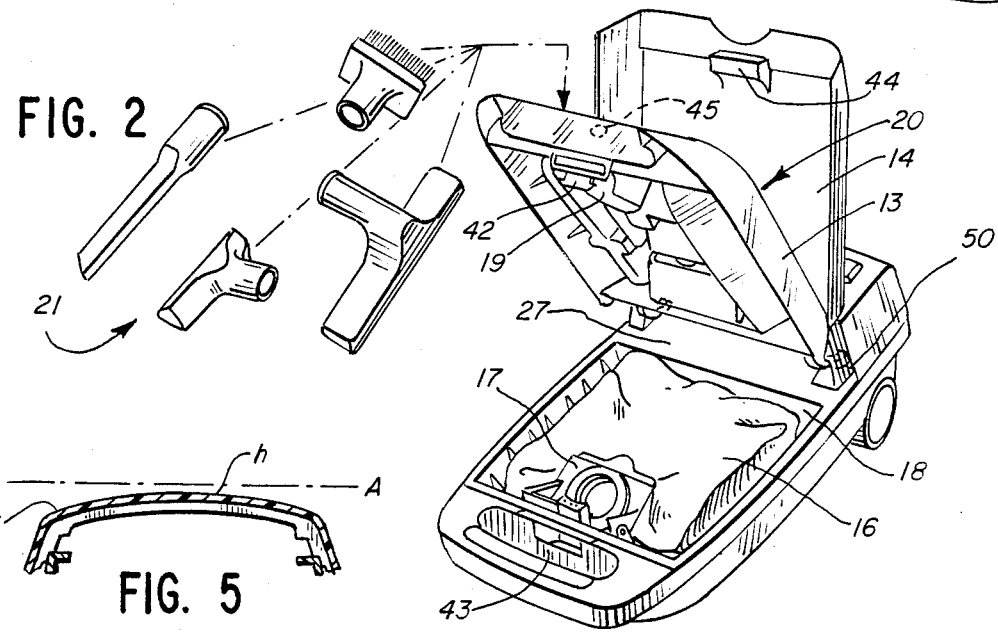
FIG. 2
FIG. 5
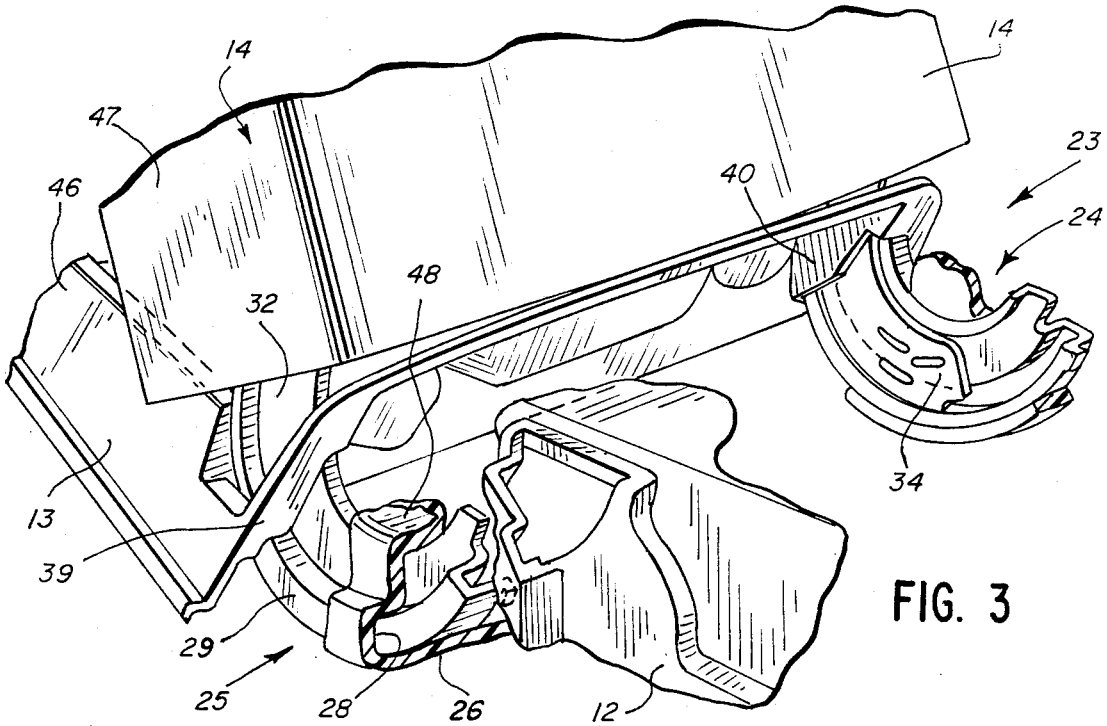
FIG. 3

FIG. 4
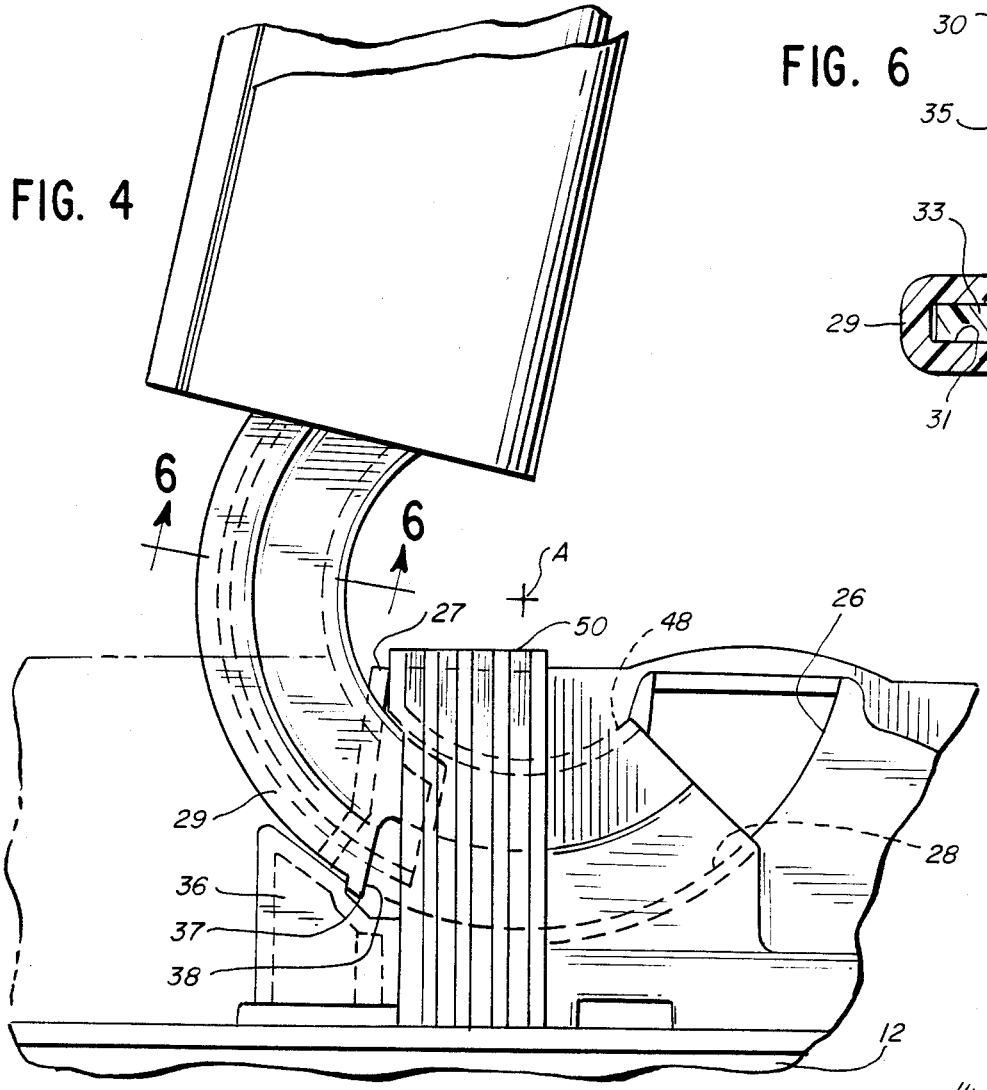
FIG. 6
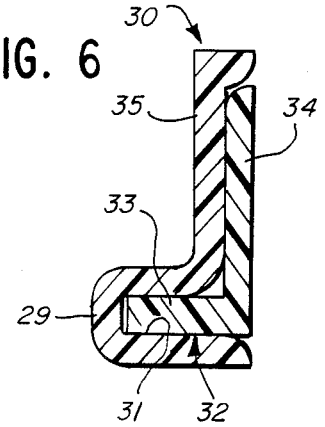
FIG. 7
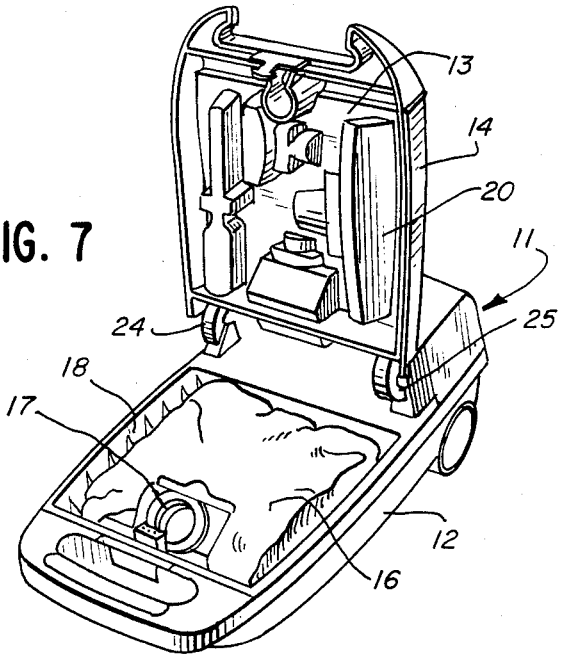
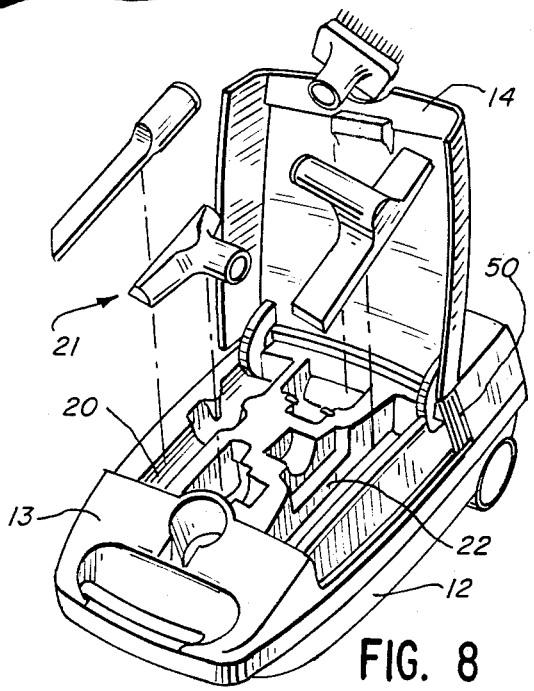
FIG. 8

INVISIBLE HINGE MEANS FOR LID AND HOOD OF A CANISTER VACUUM CLEANER

BACKGROUND OF THE INVENTION

1. Field of the Invention

This invention relates to appliances, such as vacuum cleaners, and in particular to invisible hinge menas for mounting the hood and/or lid of a canister-type vacuum cleaner.

2. Description of the Background Art

In U.S. Pat. No. 3,200,432 of Donald H. Voegeli et al., a canister-type vacuum cleaner is disclosed having a base and a cover therefor. The base defines means for storing the suction hose and the cover is provided with means for mounting a plurality of attachment tools for use with the hose. The cover is pivotally mounted to a rear portion of the base on a pivotal L bracket.

In U.S. Pat. No. 2,494,347 of Arthur F. Matthews, a roller type hinge is disclosed wherein a roller means cooperates with a curved track means in providing hinged mounting of an element to another element.

In U.S. Pat. No. 4,123,822, Frank A. Bentley discloses a pinless hinge structure wherein one member has a slot and defines first and second bearing surfaces on opposite sides of the slot. The second member has opposed, generally convex and concave surfaces so that when the first and second members are assembled to form the hinge structure, the generally convex and concave surface confront the first and second bearing surfaces respectively so as to permit the members to pivot with respect to each other.

SUMMARY OF THE INVENTION

The present invention comprehends an improved vacuum cleaner structure wherein a hood is pivotally mounted to the body of the canister so as to cover a filter bag receptacle portion of the body in a closed position. A lid is hingedly mounted to the hinge means of the hood for selectively covering a portion of the hood defining a receptacle for attachment tools, and the like.

The hinged means permits swinging movement of the hood and lid as a unit to an upright position, providing facilitated access to the filter bag space, such as for removal and replacement of the filter bag, as desired.

The hood defines an attachment tool receptacle portion wherein recesses are provided for receiving different attachment tools adapted to be removably connected to the suction hose removably connected to the canister. In a closed position, the lid covers the attachment tool receptacle portion. The lid may be swung away from the cover so as to expose the attachment tool receptacle portion, permitting the user selectively to remove and replace the attachment tools as desired without removing the hood from the body.

In the illustrated embodiment, the hinge means for mounting the lid pivotally to the hood comprise means slidably mounted on the hinge means for mounting the hood pivotally to the canister body.

The hinge menas are arranged so as to be invisible in the closed position of the hood and lid.

The body defines an arcuate guide in which the hood hinge means pivotally slides about a pivot axis.

The hood hinge means defines a track for receiving a slide of the lid hinge means, permitting the hinge lid means to swing pivotally also about the same axis.

In the illustrated embodiment the lid hinge and the hood hinge which are invisible in the closed disposition of the canister, both pivot about a common pivot axis which common pivot axis is spaced outside the confines of the vacuum cleaner canister whereby the lid and hood may be freely opened and closed without interference with each other.

Stop means are provided for limiting the swinging movement of the lid and hood, such as to a substantially upright position in the open disposition of the lid and/or hood.

In the illustrated embodiment, the hood may swing to a slightly overcenter upright position so as to be releasably retained in the open disposition during the bag-changing operation.

In the illustrated embodiment, the lid hinge means is removably mounted to the hood hinge means and the hood hinge means is removably mounted to the hinge guide carried by the canister body.

In the illustrated embodiment, a slide is integrally formed with the lid to define the lid hinge means.

In the illustrated embodiment, a slide track is integrally formed with the hood to define the hinge means thereof cooperating with a guide formed in the canister body.

Latch means are provided for retaining the lid in the closed disposition and for retaining the hood in the closed disposition, as desired.

In the illustrated embodiment, the latch means for latching the lid to the hood are formed integrally with the lid and hood respectively.

The improved hinge means of the present invention is extremely simple and economical of construction while yet providing an improved invisible hinge means providing facilitated access to the tool attachment receptacle and to the filter bag receptacle as desired by the user.

BRIEF DESCRIPTION OF THE DRAWING

Other features and advantages of the invention will be apparent from the following description taken in connection with the accompanying drawing wherein:

FIG. 1 is a side elevation of a vacuum cleaner canister having improved hinge means embodying the invention, a portion of the suction hose being shown attached thereto;

FIG. 2 is a perspective view illustrating the lid in the open position and the hood in a partially open position, with different attachment tools being illustrated as for placement in an attachment tool receptacle portion of the hood, the filter bag being shown in place within the body receptacle;

FIG. 3 is a fragmentary enlarged perspective view with portions broken away to facilitate illustration of the arrangement of the hinge means;

FIG. 4 is a fragmentary side elevation of the hinge means;

FIG. 5 is a fragmentary sectional elevational view taken along the line 5—5 of FIG. 1 illustrating the crowned upper surface of the canister lid and its relationship to the common pivot axis of the lid and hood hinges;

FIG. 6 is a transverse section taken substantially along the line 6—6 of FIG. 4 illustrating the cooperative arrangement of the lid slide with the hood slide track.

FIG. 7 is a perspective view of the vacuum cleaner canister with the hood pivoted to an open position illustrating the disposition of the filter bag within the receptacle space; and FIG. 8 is a perspective view of the vacuum cleaner canister with the lid pivoted to an open position and the hood in closed position illustrating the placement of the different attachment tools in the receptacle position of the hood.

DESCRIPTION OF THE PREFERRED EMBODIMENT

In the illustrative embodiment of the invention as disclosed in the drawing, a vacuum cleaner structure generally designated 10 is shown to include a wheeled canister 11 having a body 12, a hood 13, and a lid 14. A suction hose 15 is removably connected to a filter bag 16 by means of a hose connector 17 within a filter bag receptacle space 18 in body 12 and removably covered by hood 13. The hood is provided with a hose inlet connector 19 for receiving the end of the hose in alignment with the connector 17 for facilitated removable connection of the hose to the filter bag, as desired.

Hood 13 defines a receptacle portion 20 defining a plurality of upwardly opening recesses for receiving a plurality of correspondingly shaped attachment tools generally designated 21, as illustrated in FIGS. 2 and 8. One such upwardly opening tool-receiving space 22 for receiving a floor brush tool is illustrated in FIG. 8.

As shown in FIG. 3, hood 13 and lid 14 are cooperatively hingedly mounted to body 12 by hinge means generally designated 23 comprising a pair of pinless hinges 24 and 25 at opposite sides of the canister. A decorative grillwork 50 may be employed at the rear of lid 14 to separate the hinged lid 14 from the rear portion of the vacuum cleaner canister. Hinges 24 and 25 are reversely similar and, thus, detailed description of hinge 25 applies equally to hinge 24.

More specifically, as illustrated in FIGS. 3 and 4, body 12 defines an arcuate guide 26 which opens through an upright wall 27 at the rear of the filter bag space 18. As shown in FIG. 3, guide 26 defines an arcuate inwardly opening channel 28.

The channel 28 slidably receives a complementary arcuate slide 29 of a slide track generally designated 30 formed integrally with the hood 13.

As best seen in FIG. 6, the slide track further defines a channel 31 defining a track receiving a complementary annular slide 32 formed integrally with the lid 14. As shown in FIG. 6, the slide 32 may comprise an L-shaped slide having an outturned flange portion 33 received in the track 31, and an upright wall portion 34 slidably engaging the inner surface of an upright portion 35 of slide track 30.

A bearing post 36 is provided at the end of wall 27. The bearing post defines a stop surface 37 which is engaged by a projecting stop 38 at the rear end of the slide track 30 for limiting the pivotal movement of the slide track to a position wherein the hood 13 is in an upright position slightly over vertical center, thereby maintaining the hood and lid as a unit in a filter bag-exposing disposition, as shown in FIG. 7. In this arrangement, the user has facilitated access to the filter bag space 18 for facilitated removal and replacement of filter bag 16, as desired.

Hood 13 defines a transversely extending rear wall 39 provided with a pair of rearwardly extending stops 40. The rear portion of upright wall 34 is provided with a plurality of cooperating nibs 41 which, when engaging the stops 40, effectively releasably limit the swinging of the lid 14 on the hood 13 to an upright disposition, as seen in FIG. 8, exposing the attachment tray receptacle for facilitated removal and replacement of the attachment tools.

Thus, as shown in FIG. 4, the hood and lid are severally and jointly pivotable about an axis A defining the center of curvature of guide 26, with the rearwardly projecting slide track 30 of the hood and slide 32 of the lid being recessed behind wall 27 within the canister body 12 in the closed disposition of the hood and lid. Thus, the hinge means of the present invention comprehends an improved, novel, pinless, invisible hinge structure.

The present invisible hinge invention may be employed in a structure in which the pivot axis of the hinges is parallel to the wall surface along which it extends. Illustratively, in the disclosed embodiment the lid 14 has a curved, somewhat rounded, crowned surface only approximately parallel to the pivot axis A, with a high point h substantially at the centerline of the canister 11 as indicated in FIG. 5. The pivot axis A, which is common for the hood 13 and the lid 14, is spaced above the highest point of the vacuum cleaner in the line of the hinges and above the upper surface of 14 and wholly outside the confines of the vacuum cleaner canister 11. In this disclosed arrangement the lid and hood may be freely swung about their common pivot axis in the opening and closing movements of the lid and hood without interference with each other and without interference with upper portions of the body of the canister behind the lid. Specifically, the disclosed arrangement permits the lid to hood latch 44, referred to below, to lock and enables the hood 13 to freely clear the canister body without interference. Moreover, there is no need to undercut or otherwise relieve the upper surface of the top of the canister behind the lid to accommodate movement of the lid, enabling a smooth, aesthetically pleasing appearance for the upper surface of the vacuum cleaner canister.

Hood 13 may be releasably latched to the body by cooperating latch means 42 on the hood and latch means 43 on the body. Lid 14 may be releasably latched to the hood 13 by cooperating latch means 44 on the lid and 45 on the hood. Latch means 44 may be formed integrally with the lid and latch means 45 may be formed integrally with the hood, as by forming each of these elements as a synthetic resin molded element.

In the illustrated embodiment, hood 13 defines side recesses 46 receiving downturned sidewalls 47 of the lid 14 so as to provide a recessed disposition of lid 14 in the closed disposition of the hood and lid, as shown in FIG. 1.

As shown in FIG. 4, guide 28 further defines an upper arcuate wall 48 limiting upward displacement of the slidetrack 30 from the guide 28 for improved guided hinged movement of the hood.

The improved hinged hood and lid structure of the present invention is extremely simple of manufacture as each of the hinge portions may be formed integrally with the hood, lid and body, respectively, permitting facilitated manufacture and servicing. The improved hinge structure defines a highly desirable invisible hinge means, while yet permitting facilitated long life hinging of the lid to the hood and the hood to the body for facilitated use of the attachment tool receptacle and filter bag receptacle portions of the canister, as desired.

The foregoing disclosure of specific embodiments is illustrative of the broad inventive concepts comprehended by the invention.

I claim:

1. In an appliance having a body defining a first receptacle and a wall portion at one edge portion of the receptacle, the improvement comprising:

arcuate guide means on said body;

a first lid for covering said receptacle, said first lid defining a second receptacle and having arcuate slide-track means, said slide-track means defining an arcuate first slide slidably received in said arcuate guide for selective swinging of said first lid about an axis defined by said guide means, said slide-track means further defining an arcuate track concentric to said axis; and a second lid for covering said second receptacle and having an arcuate second slide slidably received in said arcuate track for selective swinging of said second lid relative to said first lid, whereby said first and second lids may be swung as a unit to uncover said first receptacle and said second lid may be selectively swung away from said first lid to uncover said second receptacle as desired.

2. The appliance of claim 1 wherein said arcuate guide comprises an arcuate track formed integrally in said body.

3. The appliance of claim 1 wherein said guide means comprises a pair of arcuate tracks adjacent opposite sides of said first receptacle.

4. The appliance of claim 1 wherein said first lid defines a recess opening to said second receptacle and said second lid is received in said recess when covering said second receptacle.

5. The Appliance of claim 1 wherein said slide-track means is received within said body when said first lid is covering said first receptacle.

6. The appliance of claim 1 wherein said slide-track means is received within said body when said first lid and said second lid are covering said first receptacle and said second lid is covering said second receptacle.

7. The appliance of claim 1 further including cooperating stop means on said body and slide-track means for limiting the swinging of said first lid.

8. The appliance of claim 1 further including cooperating stop means on said body and slide-track means for limiting the swinging of said first lid to an overcenter upright position for releasably maintained access to said first receptacle.

9. The appliance of claim 1 further including cooperating latch means on said body and first lid for releasably locking said first lid to said body in a first receptacle covering disposition.

10. The appliance of claim 1 further including cooperating latch means on said first lid and second lid for releasably locking said second lid to said first lid in a second receptacle covering disposition.

11. The appliance of claim 1 further including cooperating stop means on said slide-track and first slide for limiting the swinging of said first lid.

12. The appliance of claim 1 further including cooperating stop means on said slide-track and first slide for limiting the swinging of said first lid to an upright position for releasably maintained access to said second receptacle.

13. The appliance of claim 1 wherein said axis defined by said guide means defines a common pivot axis for both said first lid and said second lid.

14. The appliance of claim 1 wherein said first lid and said second lid are severally and jointly pivotable about said axis defined by said guide means.

15. The appliance of claim 1 wherein said axis defined by said guide means is spaced outside the confines of the body of said appliance whereby said first lid and said second lid may be freely swung about said axis free of interference with said body and with each other.

16. In a vacuum cleaner canister having a body defining a bag receptacle and a wall portion at one edge portion of the bag receptacle, the improvement comprising:

arcuate guide means on said body;

a hood for covering said bag receptacle, said hood defining an attachment tool tray and having arcuate slide-track means, said slide-track means defining an arcuate first slide slidably received in said arcuate guide for selective swinging of said hood about an axis defined by said guide means, said slide-track means further defining an arcuate track concentric to said axis; and a lid for covering said tray and having an arcuate second slide slidably received in said arcuate track for selective swinging of said lid relative to said hood, whereby said hood and lid may be swung as a unit to uncover said bag receptacle and said lid may be selectively swung away from said hood to uncover said tray as desired.

17. The vacuum cleaner canister structure of claim 16 wherein said slide-track means is formed integrally with said hood.

18. The vacuum cleaner canister structure of claim 16 wherein said second slide is formed integrally with said lid.

19. The vacuum cleaner canister structure of claim 16 further including cooperating latch means on said hood and lid for releasably locking said lid to said hood in a traycovering disposition, said latch means being formed integrally with said hood and lid respectively.

20. The vacuum cleaner canister structure of claim 16 wherein said second slide defines an L-shaped cross section.

21. The vacuum cleaner canister structure of claim 16 wherein said track defines an annular recess and said second slide includes an annular wall slidably received in said recess.

22. The vacuum cleaner canister structure of claim 16 wherein said track defines an annular recess and said second slide includes an annular flange slidably received in said recess.

23. The vacuum cleaner canister structure of claim 16 wherein said second slide is removably mounted to said slidetrack means.

24. The vacuum cleaner canister structure of claim 16 wherein said slide-track means is removably mounted to said guide.

25. In a vacuum cleaner canister as claimed in claim 16 wherein said hood and said lid swing about a common pivot axis in their selective swinging movements.

26. In a vacuum cleaner canister as claimed in claim 25 wherein said common pivot axis is outside the space defined by the body of the canister facilitating selective swinging movement of said hood and said lid relative to said body free of interference with said body.

* * * * *